US011604437B2

(12) United States Patent
Leskerpit et al.

(10) Patent No.: US 11,604,437 B2
(45) Date of Patent: Mar. 14, 2023

(54) MOVING MECHANISM FOR A DECORATIVE ELEMENT OF A TIMEPIECE

(71) Applicant: Montres Jaquet Droz SA, La Chaux-de-Fonds (CH)

(72) Inventors: Julien Leskerpit, Pontarlier (FR); Bernat Monferrer, St-Prex (CH); Julien Feyer, Vernier (CH); Pierre Isambert, Morbier (FR); Edmond Capt, Le Brassus (CH)

(73) Assignee: Montres Jaquet Droz SA, La Chaux-de-Fonds (CH)

( * ) Notice: Subject to any disclaimer, the term of this patent is extended or adjusted under 35 U.S.C. 154(b) by 942 days.

(21) Appl. No.: 16/377,945

(22) Filed: Apr. 8, 2019

(65) Prior Publication Data

US 2019/0332063 A1 Oct. 31, 2019

(30) Foreign Application Priority Data

Apr. 27, 2018 (EP) ..... 18169954

(51) Int. Cl.
*G04B 45/00* (2006.01)
*G04B 9/00* (2006.01)

(52) U.S. Cl.
CPC ..... *G04B 45/0038* (2013.01); *G04B 9/00* (2013.01)

(58) Field of Classification Search
CPC ..... G04B 45/0038; G04B 9/00; G04B 19/10; G04B 19/065; G04B 13/02
See application file for complete search history.

(56) References Cited

U.S. PATENT DOCUMENTS 5,359,578 A * 10/1994 Truini ..... G04B 19/00 368/76
9,471,039 B2 * 10/2016 Kim ..... G04B 45/02

FOREIGN PATENT DOCUMENTS

CH 676 074 G A3 12/1990
CH 695 797 A5 8/2006
(Continued)

OTHER PUBLICATIONS

Combined Chinese Office Action and Search Report dated Aug. 25, 2020 in Patent Application No. 201910343704.1 (with English language translation and English translation of Category of Cited Documents), 15 pages.
(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A moving mechanism for a decorative element of a timepiece including a circular drive element arranged to be rotatable about a central axis, the decorative element being mounted on the drive element with an arbor integral with the decorative element and parallel to the central axis, and first device for driving the decorative element in a rotational motion about its own arbor and/or in a translational motion along its own arbor, the first drive device for the decorative element being mounted on the circular drive element and arranged to cooperate with fixed actuation device arranged in the periphery of the circular drive element such that the decorative element rotates about its arbor and/or moves along its arbor while rotating about the central axis.

16 Claims, 8 Drawing Sheets

(56) References Cited

FOREIGN PATENT DOCUMENTS

| | | | |
|---|---|---|---|
| CH | 712 268 | A2 | 9/2017 |
| CN | 100538556 | C | 9/2009 |
| CN | 104685425 | A | 6/2015 |
| JP | 57-156883 | | 10/1982 |
| JP | 7-016192 | | 3/1995 |
| JP | 7-16192 | U | 3/1995 |
| JP | 10-033835 | | 2/1998 |
| JP | 10-197661 | A | 7/1998 |

OTHER PUBLICATIONS

European Search Report dated Oct. 26, 2018 in European Application 18169954.7, filed on Apr. 27, 2018 (with English translation of categories of Cited Documents and Written Opinion).

* cited by examiner

MOVING MECHANISM FOR A DECORATIVE ELEMENT OF A TIMEPIECE

CROSS-REFERENCE TO RELATED APPLICATION

This application claims priority to European Patent Application No. 18169954.7 filed on Apr. 27, 2018, the entire disclosure of which is hereby incorporated herein by reference.

FIELD OF THE INVENTION

The invention relates to a moving mechanism for a decorative element of a timepiece. The invention also relates to a timepiece including such a moving mechanism.

BACKGROUND OF THE INVENTION

A moving mechanism and timepiece of this type are disclosed, for example, in European Patent No EP 2880498 by the Applicant. The decorative element is formed by a mechanical bird arranged such that its body rotates on itself about an axis perpendicular to the dial, whereas the head, the tail and the wings rotate about non-perpendicular axes.

The moving mechanism proposed in EP 2880498 is specifically provided for a decorative element or automaton of the bird type arranged on a perch. Other moving mechanisms are sought after in order to propose a timepiece that can implement decorative parts or automatons made to move in combined complex movements, different from those of a bird on a perch.

SUMMARY OF THE INVENTION

To this end, the invention relates to moving mechanism for a decorative element of a timepiece.

According to the invention, said moving mechanism includes a circular drive element arranged to be rotatable about a central axis, said decorative element being mounted on the drive element by means of an arbor integral with said decorative element and parallel to the central axis, and first means for driving said decorative element in a rotational motion about its own arbor and/or in a translational motion along its own arbor, said first drive means for said decorative element being mounted or embarked on the circular drive element and arranged to cooperate with fixed actuation means arranged in the periphery of the circular drive element such that said decorative element rotates about its arbor and/or moves along its arbor while rotating about the central axis.

Advantageously, the first means for driving the decorative element in a translational motion along its own arbor can include a gear train comprising at least a first wheel set arranged to cooperate with first fixed actuation means arranged in the periphery of the drive element, and a last wheel set, said last wheel set and the arbor of the decorative element being arranged to form a screw/nut system, the decorative element arbor being further arranged at least to have limited or impeded rotation about itself at least when the first wheel set cooperates with the first fixed actuation means, such that rotation of the gear train causes translation of the decorative element arbor.

Advantageously, the first means for driving the decorative element in a rotational motion about its own arbor include a radial feeler integral at least in rotation with the decorative element arbor, the decorative element arbor and the radial feeler being mounted for free rotation on the circular drive element, said radial feeler being arranged to cooperate with second fixed actuation means arranged in the periphery of the drive element and arranged to modify the distance between the radial feeler and the central axis.

Preferably, the moving mechanism of the invention includes the first means for driving the decorative element in a translational motion along its own arbor and the first means for driving the decorative element in a rotational motion about its own arbor, in addition to the first and second fixed actuation means.

The moving mechanism according to the invention allows a decorative element to be moved in various combined motions, thereby creating a complex movement.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
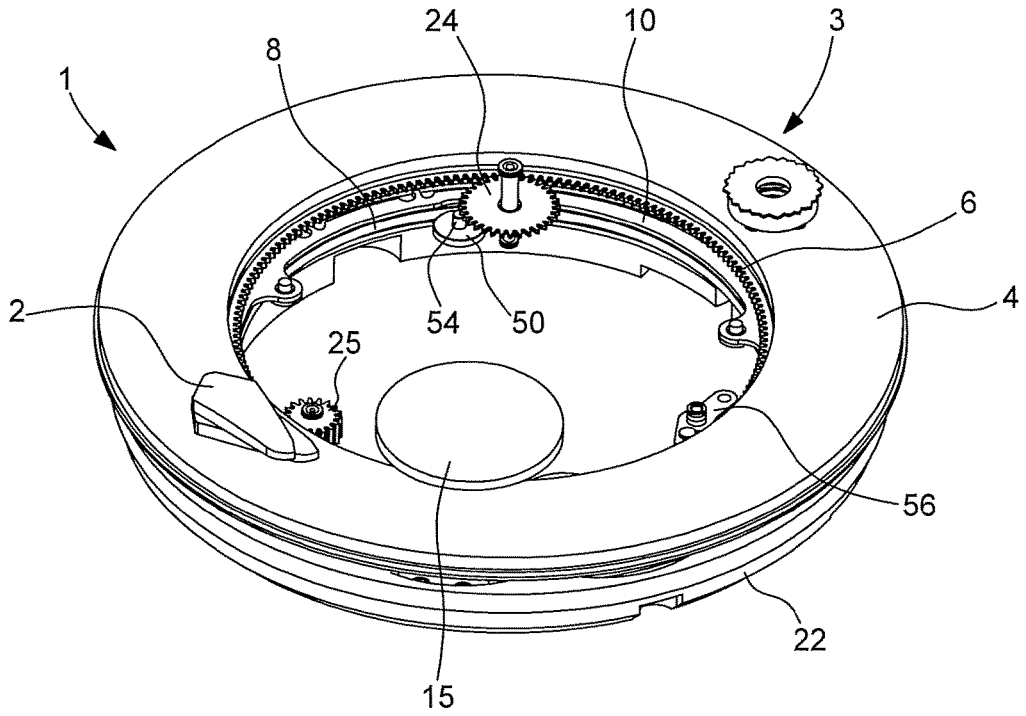
FIG. 1 is a perspective view of a moving mechanism according to the invention.

Referring to FIG. 1, moving mechanism 1 for a decorative element 2 of a timepiece includes a circular drive element 3, arranged to carry said decorative element 2. In the example represented here, circular drive element 3 is sized to correspond to the timepiece dial. It is clear that, in another, non-represented variant, the circular drive element could be sized to occupy only part of the timepiece dial. In the variant represented, circular drive element 3 is hollowed at its centre so that it is of annular shape. Consequently, in the following description, the terms "circular drive element" and "annular drive element" will be used alike to designate the part referenced 3.

Figure 2:
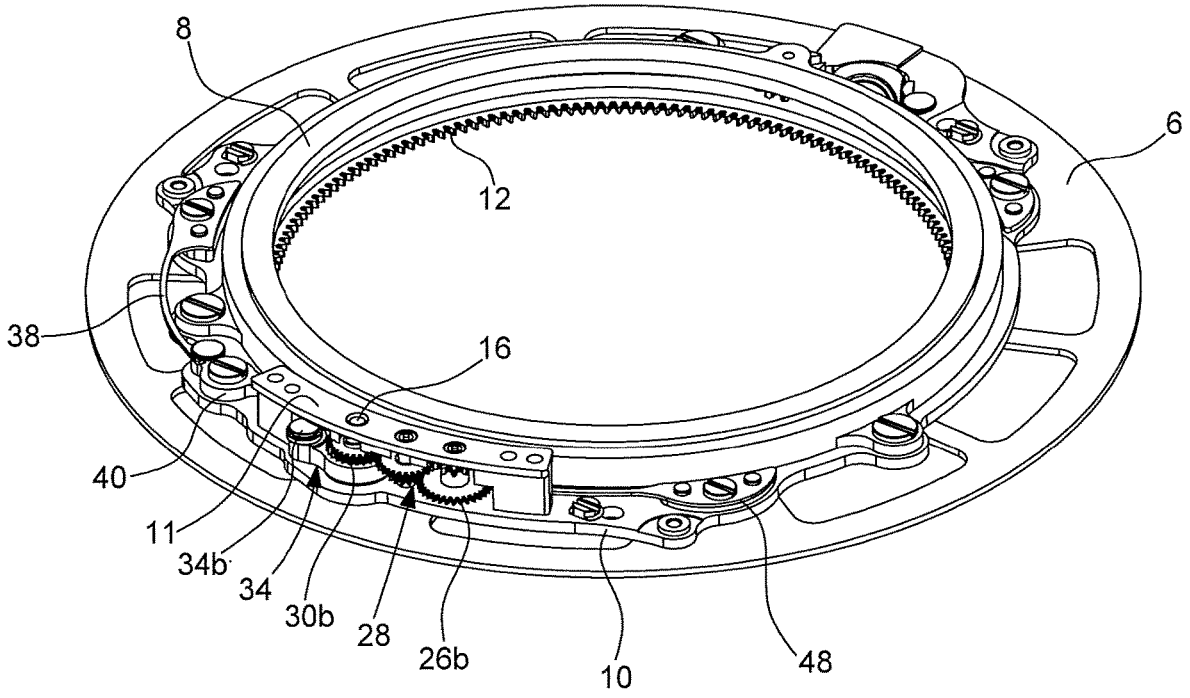
FIG. 2 is a perspective, bottom view of the moving mechanism according to the invention.
Figure 3:
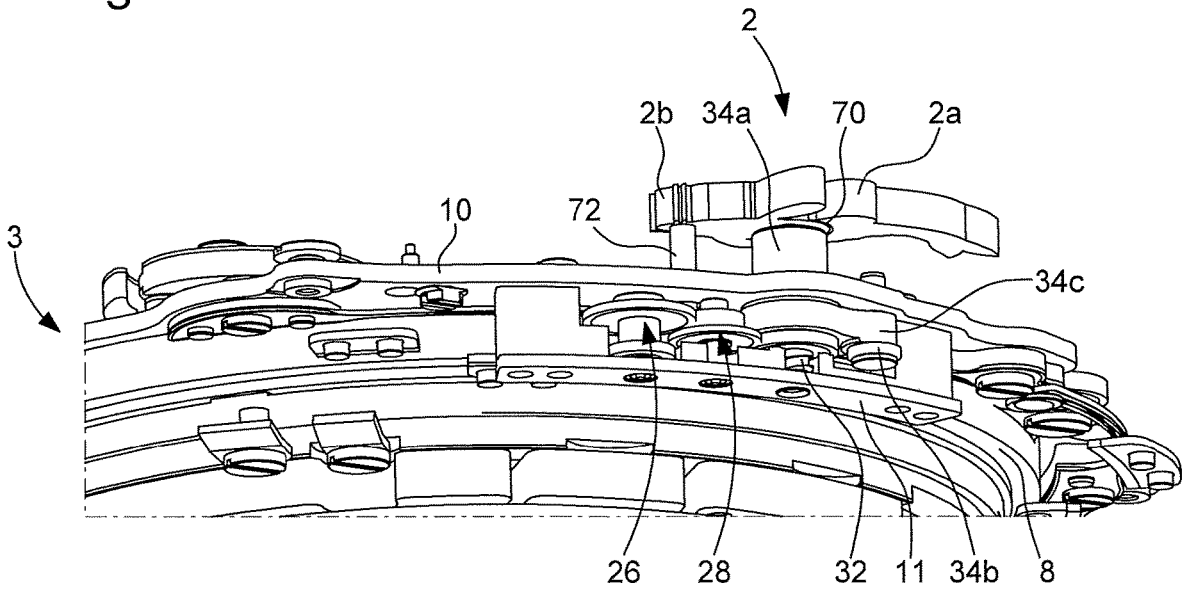
FIG. 3 is a partial perspective view of the moving mechanism according to the invention.
Figure 4:
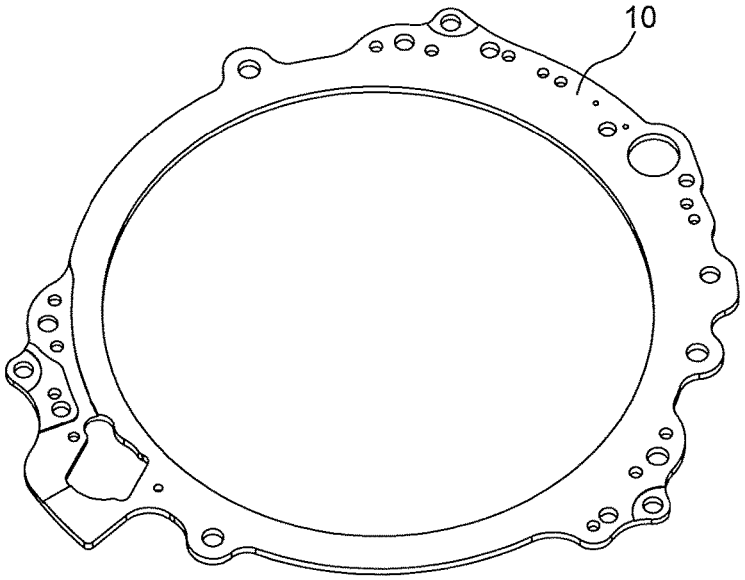
FIG. 4 is a perspective view of the rotor bridge.
Figure 5:
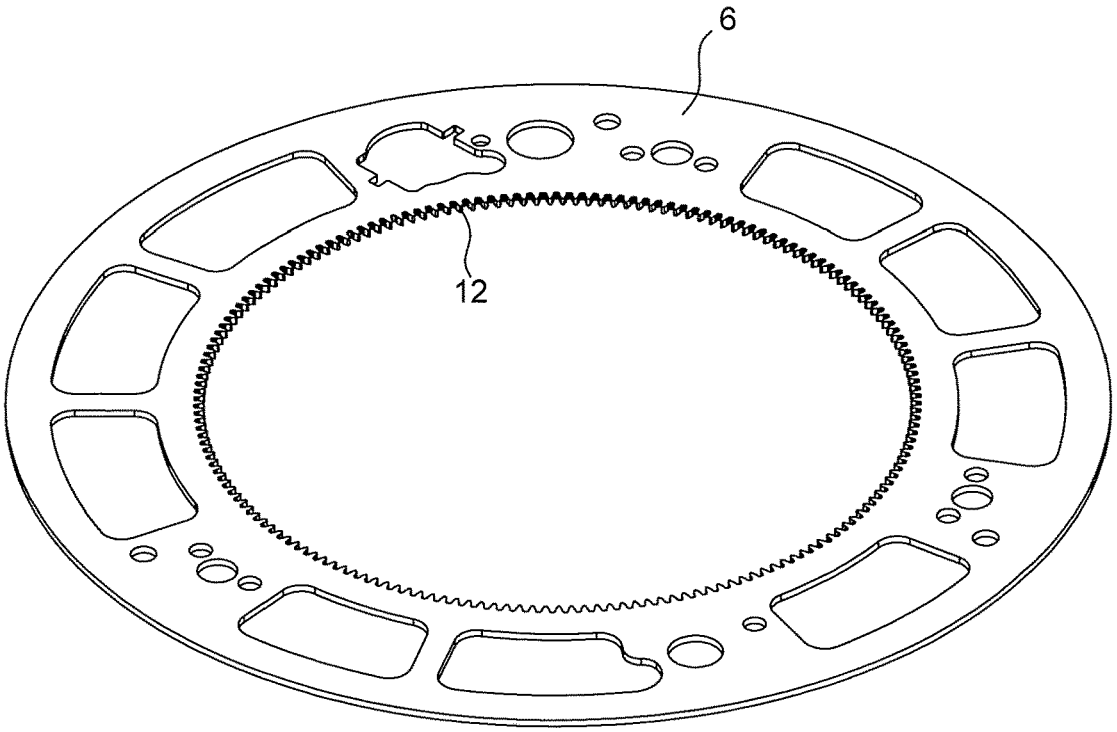
FIG. 5 is a perspective view of the drive crown.
Figure 6:
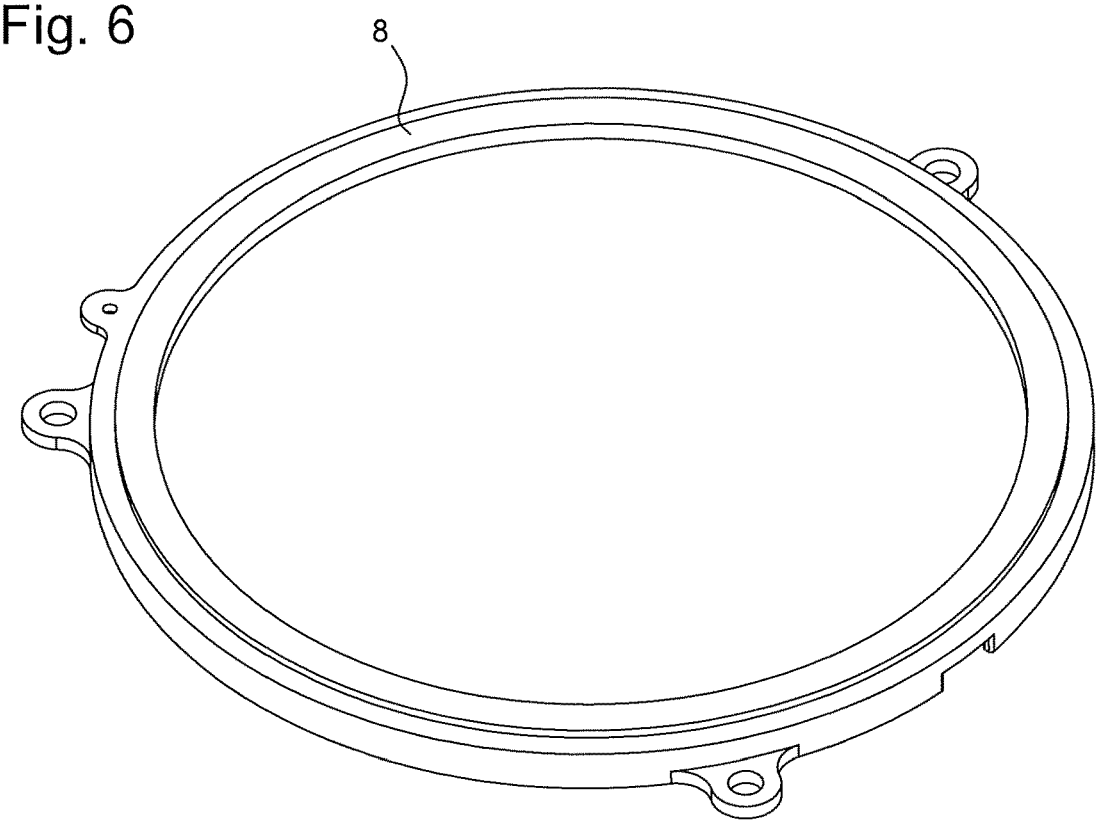
FIG. 6 is a perspective view of the rotor.
Figure 9:
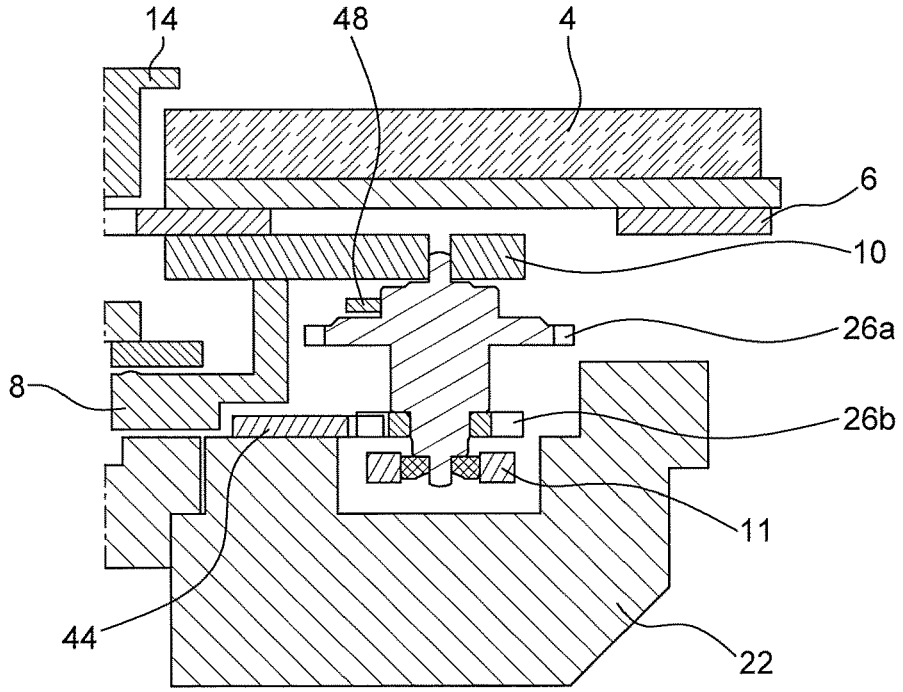
FIG. 9 is a sectional view of the first wheel set meshing with an inner rack with external teeth.

Advantageously, circular drive element 3 includes a movable dial 4, a drive crown 6, in addition to a rotor 8 and a rotor bridge 10, of annular shape, as more particularly shown in FIGS. 4 to 6. Rotor 8, rotor bridge 10, drive crown 6 and movable dial 4 are superposed and integrally mounted with each other. Drive crown 6 is disposed between movable dial 4 and rotor bridge 10. Further, as shown in FIGS. 2, 3 and 9, circular drive element 3 includes an automaton bridge 11 assembled underneath rotor bridge 10, rotor bridge 10 and automaton bridge 11 being arranged to carry decorative element 2 and its means for rotational driving about its own arbor and translational driving along its own arbor, referred to as the 'first drive means', as will be described hereinafter. Automaton bridge 11 is secured underneath the rotor bridge and has a concentric shape to rotor 8, in order to be as close as possible to the fixed actuation means provided on the frame in the periphery of drive element 3, as will be described hereinafter.

In the variant represented here, drive crown 6 has an inner toothing 12 disposed on its inner peripheral edge, whose purpose will be described hereinafter.

The hollow centre of annular drive element 3 is filled by a fixed dial 14 (cf. FIG. 9), integral with the frame and traversed by the arbor of the hands (not shown) for displaying the hours and minutes. Fixed dial 14 can bear fixed decorative elements 15, positioned entirely on fixed dial 14 or in such a way as to be partially above annular drive element 3.

According to the invention, circular drive element 3 is arranged to be rotatable about its own arbor, which is perpendicular to the plane defined by the circular drive element, said arbor being referred to as the central arbor. The central arbor is preferably parallel to the arbor of the hands and it may be different from the arbor of the timepiece case. To this end, circular drive element 3 is mounted to pivot on the timepiece frame.

Figure 13:
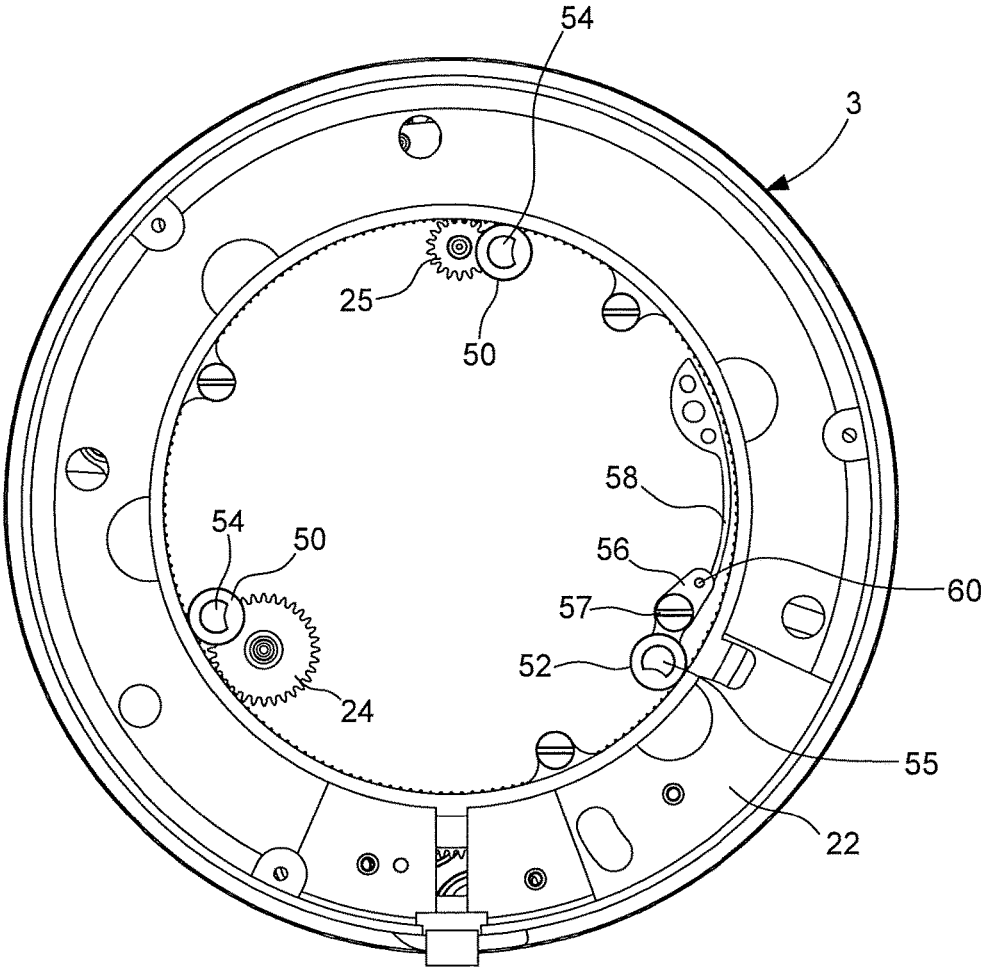
FIG. 13 is a bottom view of the drive element.
Figure 14:
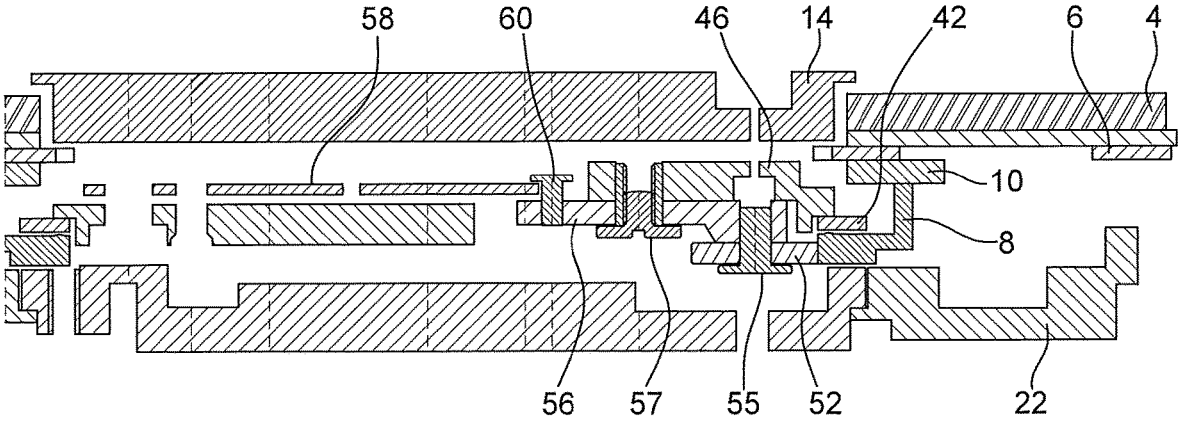
FIG. 14 is a sectional view of the mobile runner.

Preferably, circular drive element 3 is held radially on the frame by at least two runners mounted on the frame, one of the runners being fixed and the other runner being mobile. In the present example, and with reference to FIGS. 13 and 14, there are three runners 50, 52 positioned inside annular drive element 3 at around 120°, two runners 50 being fixed and the third runner 52 being mobile. The two fixed runners 50 are mounted to pivot on a pin 54 fixed to plate 46, in contact with rotor 8. The third, mobile runner 52 is mounted to pivot about an axis 55, on a mobile runner support 56. Said mobile runner support 56 is in turn mounted to pivot on plate 46 about an axis 57, allowing mobile runner 52 to come into contact with rotor 8. A mobile runner spring 58 is mounted on the frame, its free end resting on a support member 60 arranged on mobile runner support 56. Mobile runner 52 takes up assembly play in annular drive element 3, removing any unwanted radial motion and ensuring optimum performance.

Circular drive element 3 is arranged to cooperate with rotational drive means (referred to as the 'second drive means') about the central axis.

Advantageously, said second means for driving circular drive element 3 in rotation about the central axis are arranged to cooperate with drive crown 6. More precisely, the second means for rotational driving of circular drive element 3 about the central axis include a wheel set 24 of a going train cooperating with a barrel (not represented), which is the energy source for powering the moving mechanism. Said wheel set 24 is preferably disposed on the frame in proximity to the inner peripheral edge of drive crown 6, in order to mesh with internal toothing 12 and drive in rotation drive crown 6, and thereby the entire first drive means for annular drive element 3. An intermediate wheel 25 cooperating with a governor or speed regulator (not represented) is also provided. Said intermediate wheel 25 is disposed on the frame preferably in proximity to the inner peripheral edge of drive crown 6 in order to mesh with internal toothing 12 and to regulate the rotational speed of drive crown 6, and thereby of all the elements of annular drive element 3. It is clear that it is also possible to provide a main gear train from the barrel to the governor and a secondary gear train from the main train to the moving mechanism.

Decorative element 2 is a three-dimensional object and includes at least a body 2*a* mounted on drive element 3 by means of an arbor 16 integral with said decorative element 2. More specifically, arbor 16 of decorative element 2 is freely mounted about a tube 17 coaxial with arbor 16 and mounted on automaton bridge 11 of drive element 3 parallel to the central axis. Arbor 16 is thus offset from and parallel to the central axis. Arbor 16 is thus perpendicular to the plane defined by drive element 3. Body 2*a* of the decorative element is arranged to be above movable dial 4, on the user side. Movable dial 4, drive crown 6 and rotor bridge 10 respectively include an aperture arranged for passage of arbor 16 of decorative element 2.

Decorative element 2 may represent any type of person, a flower, a stone, an animal such as a fish.

Figure 11:
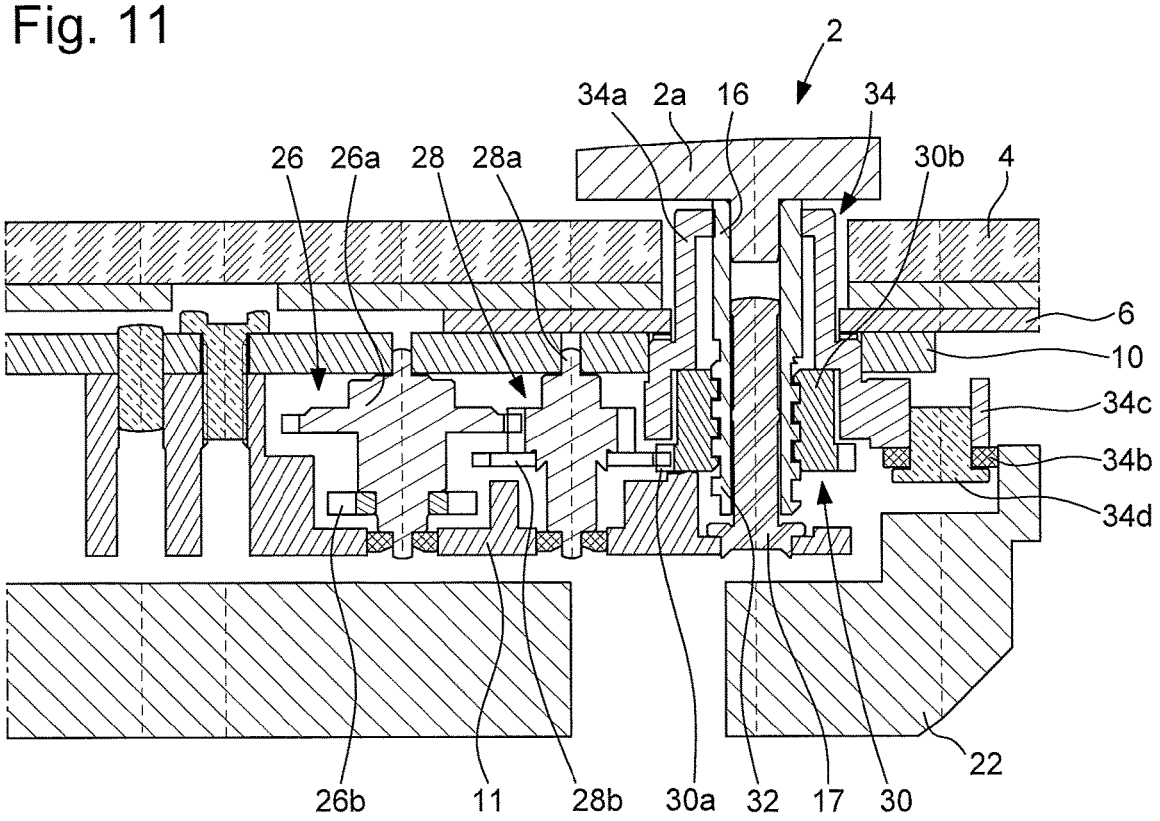
FIG. 11 is a sectional view of the moving mechanism in another variant of the invention, with the decorative element in the low position.
Figure 12:
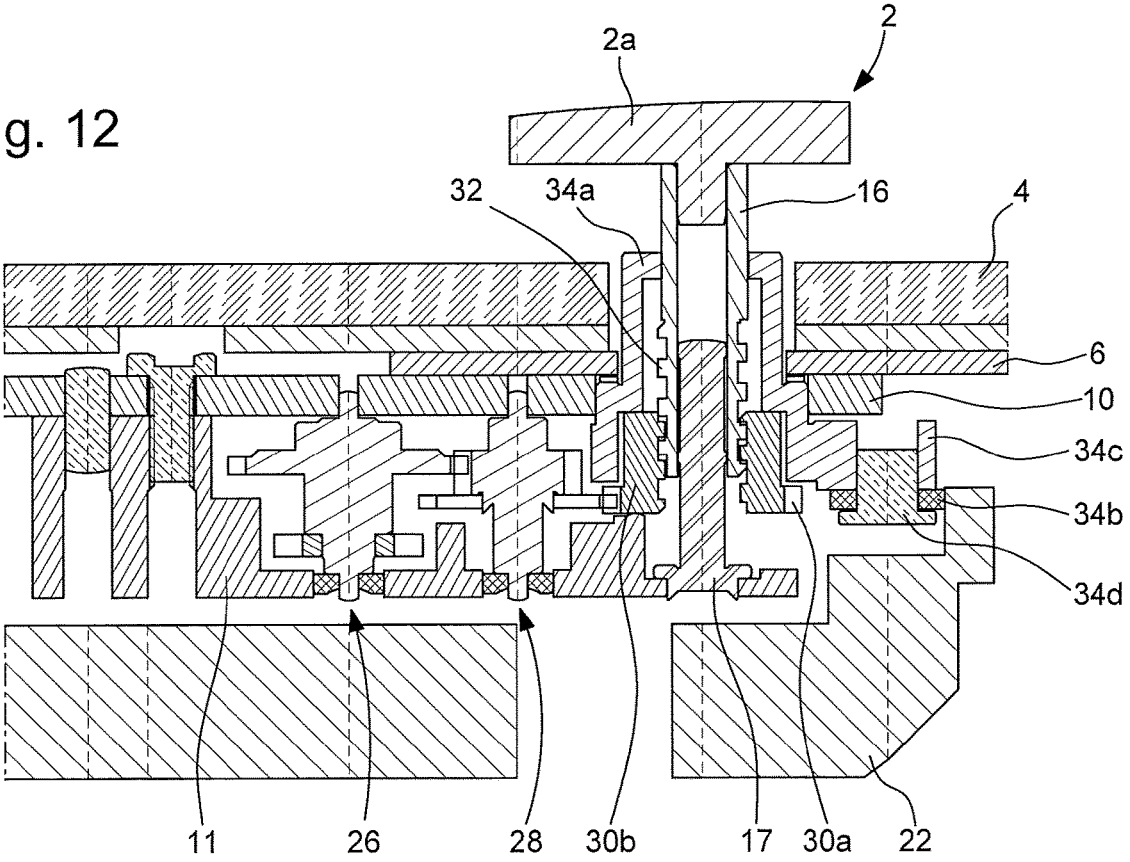
FIG. 12 is a sectional view of the moving mechanism according to the variant of FIG. 11, with the decorative element in the high position.

In the variant represented in FIGS. 11 and 12, decorative element 2 has a one-piece body 2*a*.

In the example of the invention, decorative element 2 is mounted to rotate about its own arbor 16 and to move in translation along its own arbor 16, while being rotatable about the central axis.

To this end, decorative element 2 is driven in rotation about its arbor 16 and in translation along its arbor 16 by first means for driving it in rotation about its own arbor 16 and in translation along its own arbor 16, said first means for translational and rotational driving of decorative element 2 with respect to its own arbor 16 being mounted or embarked on circular drive element 3 and arranged to cooperate with fixed actuation means arranged in the periphery of circular drive element 3, such that said decorative element 2 rotates about its arbor 16 and moves along its arbor 16 while rotating about the central axis.

Advantageously, the first means for driving decorative element 2 in a translational motion along its own arbor 16 include a gear train comprising three wheel sets in the represented example, namely a first wheel set 26, comprising a first pinion 26*a* and a first wheel 26*b* arranged to cooperate with first fixed actuation means, such as at least one rack with external teeth and one rack with internal teeth, as will be described hereinafter, arranged in the periphery of drive element 3; an intermediate wheel set 28, comprising an intermediate pinion 28*a* meshing with first pinion 26*a* and an intermediate wheel 28*b*; and a last wheel set 30, comprising a last pinion 30*a* meshing with intermediate wheel 28*b* and a last wheel 30*b* arranged to cooperate with arbor 16 of decorative element 2. These three wheel sets 26, 28, 30 are mounted to pivot on circular drive element 3, about axes parallel to the central axis and to arbor 16. More specifically, the three wheel sets 26, 28, 30 are mounted between automaton bridge 11 and rotor bridge 10, so that they are mounted or embarked on circular drive element 3.

Advantageously, the last wheel set 30 and arbor 16 of decorative element 2 are arranged to form a screw/nut system. To this end, arbor 16 of decorative element 2 has an externally threaded area 32, for example of rectangular profile, and the last wheel 30*b* of last wheel set 30 has an internal thread corresponding to externally threaded area 32, which is also of rectangular profile, said last wheel set 30 being mounted around externally threaded area 32 of arbor 16 of decorative element 2.

Further, arbor 16 of decorative element 2 is arranged to have limited or impeded rotation about itself at least when first wheel set 26 cooperates with first fixed actuation means, so that rotation of the gear train causes translation of arbor 16 of decorative element 2. For example, an assembly with a square is used to create a slide-block mechanism, as will be described below. The use of a screw/nut system and a square makes it possible to transform a rotational motion into a translational motion whereby arbor 16 of decorative element 2 moves along its arbor 16 while said decorative element 2 rotates about the central axis.

The first means for driving decorative element 2 in a rotational motion about its own arbor 16 include a radial feeler 34 integral, at least in rotation, with arbor 16 of decorative element 2, and include a feeler support 34*a* of parallel axis to arbor 16 of decorative element 2 and a feeler element 34*b* mounted at the end of an arm 34*c* projecting radially from the base of feeler support 34*a*. Feeler element 34*b* can be, for example, a ruby pressed onto an arbor 34*d* fixed to the end of arm 34*c*

Feeler support 34*a* is mounted on arbor 16 of the decorative element by means of a square creating the slide block mechanism, such that radial feeler 34 is integral in rotation with arbor 16 of decorative element 2 but not in translation, to allow rotation of decorative element 2 about its own arbor 16 while allowing translation of said decorative element 2 along its own arbor 16 as already described above.

The base of feeler support 34*a* of radial feeler 34 is disposed around last wheel 30*b* of last wheel set 30 so that radial feeler 34 and arbor 16 of decorative element 2 are mounted for free rotation on drive element 3, about tube 17.

Feeler element 34*b* of radial feeler 34 is arranged to cooperate with second fixed actuation means provided in the periphery of drive element 3 and arranged to modify the distance between said second fixed actuation means and arbor 16 of the decorative element thereby forcing arm 34*c* to move in a pivoting motion and thus to rotate radial feeler 34 and arbor 16 of decorative element 2.

Figure 7:
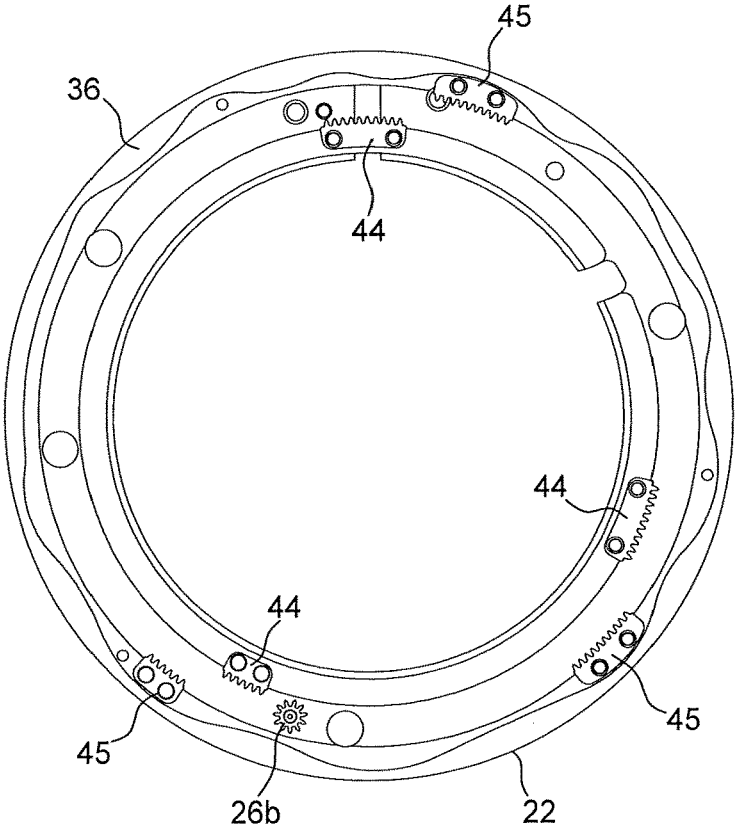
FIG. 7 is a top view of the casing ring, inner racks with external teeth and outer racks with internal teeth.
Figure 8:
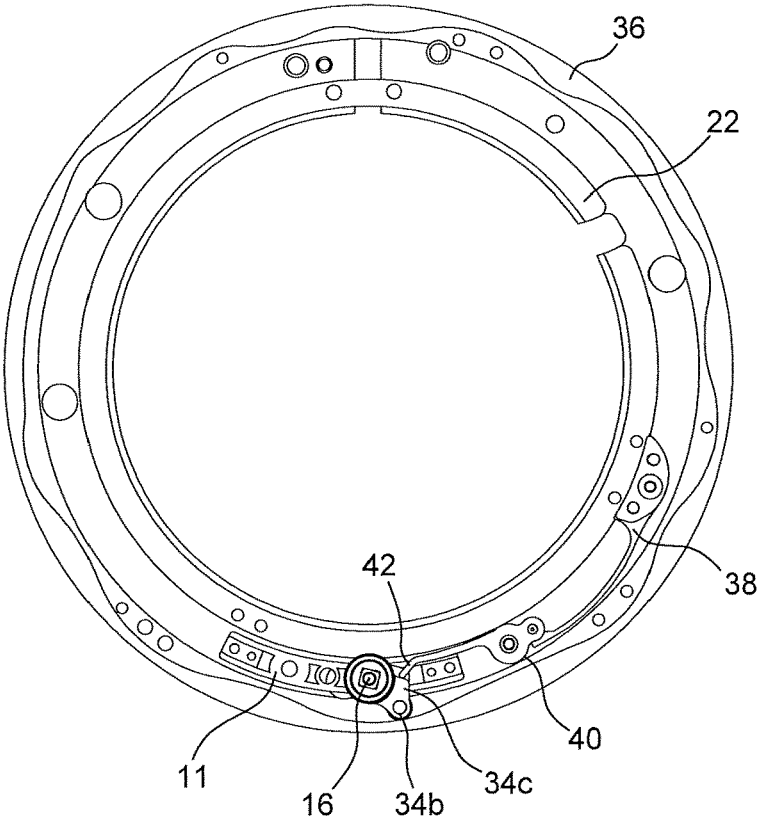
FIG. 8 is a top view of the moving mechanism of the invention.

Advantageously, and with reference to FIGS. 7 and 8, the second fixed actuation means comprise a cam 36 concentric to drive element 3 and fixedly mounted on the frame. Preferably, cam 36 is integrated in a casing ring 22 inside which the timepiece movement comprising the moving mechanism of the invention will be positioned.

Preferably, said cam 36 has a wavy profile arranged to cooperate with feeler element 34*b* of radial feeler 34 in order to move the contact point of feeler element 34 towards and then away from the centre of cam 36 and thus to create an oscillating rotational motion.

Further, as shown in FIGS. 2 and 8, there is provided, on rotor bridge 10, a radial feeler spring 38 cooperating with an intermediate lever 40 arranged to keep feeler element 34*b* constantly in contact with the profile of cam 36. To this end, at its free end, intermediate lever 40 has a beak 42 arranged to press on arm 34*c* of radial feeler 34.

In another variant of the invention wherein the decorative element is moved only in a rotational motion about its arbor, the radial feeler and the decorative element arbor may be integral or in one-piece.

Advantageously, the first fixed actuation means which cooperate with first wheel 26*b* of first wheel set 26 are arranged to create an alternating translational motion. Preferably, and with reference to FIGS. 7 and 9, the first fixed actuation means include at least a first inner rack 44 with external teeth, disposed as close as possible to the central axis, the external toothing being positioned in the direction of first wheel set 26, and a second outer rack 45 with internal teeth, disposed as far away as possible from the central axis, the internal toothing being positioned in the direction of first wheel set 26. Inner and outer racks 44 and 45 are concentric to drive element 3 and fixedly mounted on a frame, namely casing ring 22 here, in the periphery of drive element 3 so as to be positioned on either side of first wheel set 26.

Inner and outer racks 44 and 45 are arranged alternately on the edge of casing ring 22, such that their respective external and internal toothings cooperate alternately with first wheel 26*b* of first wheel set 26 when the drive element is rotating about the central axis and rotate the gear train in one direction and then the other, such that decorative element 2 alternately moves closer to and away from drive element 3 in a translational motion along its own arbor 16.

The use of a screw/nut system and a square makes it possible to transform an alternating rotational motion into an alternating translational motion wherein arbor 16 of decorative element 2 moves up to a high position, as shown in FIG. 12, or down to a low position, as shown in FIG. 11, while said decorative element 2 rotates about the central axis.

The toothing of first wheel 26*b* is calculated such that at the end of meshing with a rack, first wheel 26*b* is in a good position for meshing with the next rack.

Further, as represented in FIGS. 2 and 9, there is provided a spring 48, arranged to press on first wheel set 26 to permanently brake it slightly and thus prevent any unwanted movement due to backlash.

The ratios of the three wheel sets 26, 28, 30 are chosen to multiply the angle of rotation through which first wheel set 26 travels. These ratios depend on the value of the desired axial travel of decorative element 2 and the length of the racks.

Figure 10:
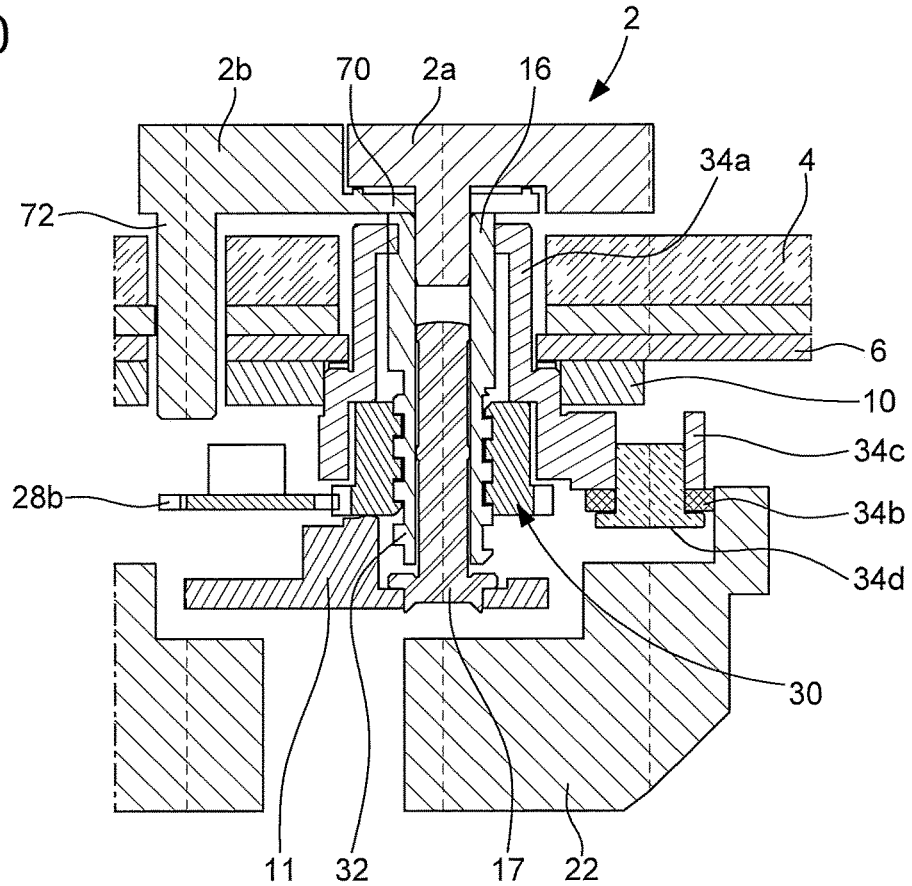
FIG. 10 is a sectional view of the moving mechanism according to a variant of the invention.

In the variant represented in FIGS. 3 and 10, decorative element 2 includes a body formed of two elements, the actual body 2*a* and a head 2*b*. Body 2*a* is moved in an alternating translational motion along its own arbor and oscillating rotational motion about its own arbor, in the same manner as the one-piece body 2*a* of the variant of FIGS. 11 and 12. Identical elements are represented with the same references. In this variant, head 2*b* includes a platform 70 on which body 2*a* is mounted for free rotation, said platform 70 being inserted between body 2*a* and arbor 16 of the decorative element, so that platform 70 rests on arbor 16, which is still integral with body 2*a*.

Head 2*b* also include an arbor 72 parallel to arbor 16 and slidably mounted in an aperture respectively provided in movable dial 4, drive crown 6 and rotor bridge 10. Tube 72 and said aperture are preferably of circular shape to prevent rotation of head 2*b* about arbor 72. Thus, head 2*b* is fixed in rotation with respect to body 2*a*, giving the impression that body 2*a* is articulated with respect to head 2*b* when said body 2*a* is moved in an oscillating rotational motion about its own arbor.

Head 2*b* is moved only in the alternating translational motion with respect to arbor 16, in association with body 2*a*. When body 2*a* is moved in the alternating translational motion along its own arbor 16 as described above, as arbor 16 rises, it presses on platform 70 and pushes it upwards, at the same time as body 2*a*. Head 2*b* rises concomitantly with body 2*a*. As it descends, arbor 16 integral with body 2*a* moves said body 2*a* down again, which presses on platform 70 and pushes it downwards. Thus, head 2*b* descends concomitantly with body 2*a*.

Drive element 3 of the moving mechanism can be supplied with energy by at least one autonomous energy accumulator, such as a barrel, independent of the energy accumulator of the movement, its speed being regulated by a governor. The barrel is arranged to be kinematically connected to wheel set 24 of the going train and the governor is kinematically connected to intermediate wheel 25.

Advantageously, the moving mechanism according to the invention can be started and stopped by an independent control mechanism of the timepiece movement.

Advantageously, such a control mechanism comprises control means arranged to exert two functions, namely first control means arranged to exert a first function consisting in starting (GO) and stopping (STOP) the moving mechanism on demand of the user; and second control means arranged to exert a second function consisting in stopping the moving mechanism when the energy of the autonomous energy accumulator is too low to ensure a good speed and proper operation of the moving mechanism, and when the energy remaining reaches a determined energy threshold. This second function allows the moving mechanism to stop by itself even if the user has not given the STOP instruction.

To perform the first STOP & GO function, the first control means of the control mechanism can include a pusher crown provided with a STOP & GO push button, a column wheel able to move between a position STOP for stopping the moving mechanism and a position GO for starting the moving mechanism, said column wheel cooperating, on the one hand with an actuation lever actuated by the push button and, on the other hand, with a first locking lever arranged to feel the STOP and GO positions of the column wheel and move between a governor locking position, for example, by locking intermediate wheel 25 which is kinematically connected to the governor, when the STOP position of the column wheel is detected; and an operating position in which said intermediate wheel 25 is not locked, and thus the governor is free, when the GO position of the column wheel is detected.

Figure 15:
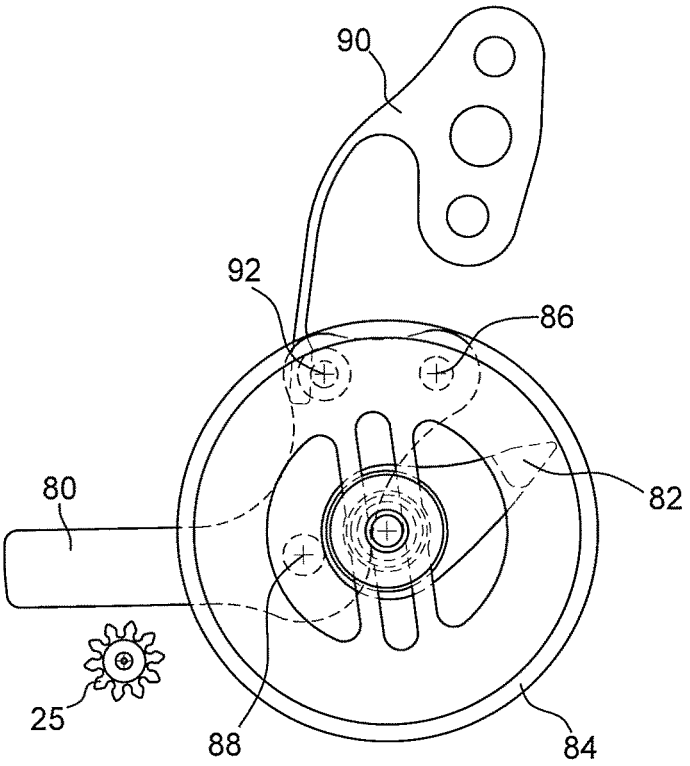
FIG. 15 is a view of the second control means of the moving mechanism control mechanism in the operating position.
Figure 16:
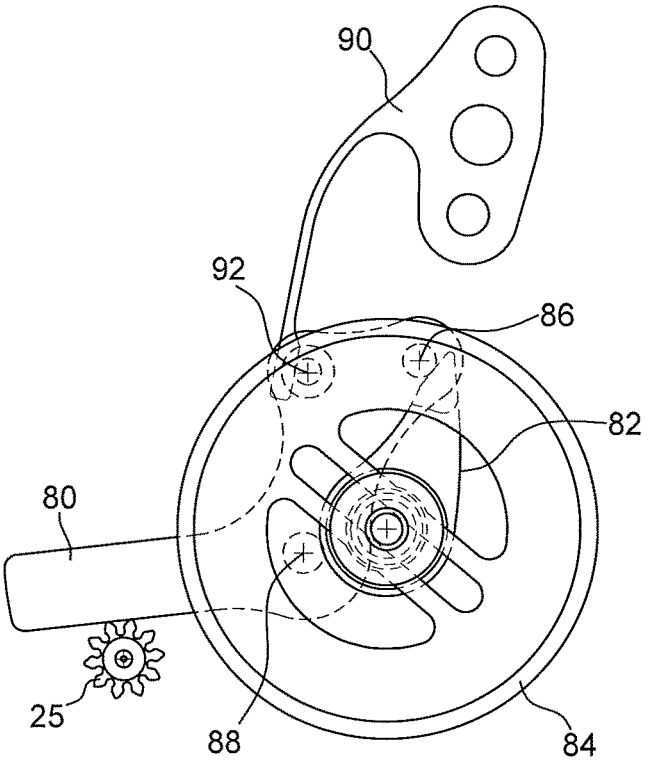
FIG. 16 is a view of the second control means of the moving mechanism control mechanism in the governor locking position.

To perform the second stop function when the energy in the barrel becomes insufficient, the second control means of the control mechanism can include, as represented in FIGS. 15 and 16, a second locking lever 80 arranged to move between an operating position (cf. FIG. 15) in which the intermediate wheel 25 which kinematically connected to the governor is not locked, so that the governor is free, when the energy in the accumulator is higher than a determined threshold; and a governor locking position (cf. FIG. 16), for example, by locking said intermediate wheel 25, when the accumulator energy reaches said determined threshold. To this end, there is provided a power reserve finger 82 integrally mounted on a power reserve display wheel set 84 kinematically connected to the energy accumulator, said power reserve finger 82 being arranged to press on a pin 86 provided on second locking lever 80, when the determined energy threshold is reached. When power reserve finger 82 presses on pin 86, second locking lever 80 tilts about its axis 88 into the locking position in order to lock intermediate wheel set 25, as shown in FIG. 16. When the energy accumulator is wound and the energy in the accumulator becomes higher than the determined threshold again, power reserve finger 82, driven by power reserve wheel set 84, moves away from pin 86, such that second locking lever 80 moves away from intermediate wheel 25 and returns to its operating position, as shown in FIG. 15. There is provided a spring 90, whose free end cooperates with a pin 92 arranged on second locking lever 80 in order to tilt said second locking lever 80 and return it to the operating position when power reserve finger 82 is no longer pressing on pin 86. This control mechanism allows the moving mechanism to restart without delay as soon as the user starts to wind the energy accumulator in the case where the push button is in the GO position.

To operate the moving mechanism according to the invention, the control mechanism is actuated by pressing on the push button in the GO position. Drive element 3 is then rotated via wheel set 24, powered by the energy accumulator and meshing with drive crown 6. Drive element 3 carries with it decorative element 2, first drive means 26, 28, 30, which activate the decorative element in a translational motion along its own arbor 16, and first drive means 34, which activate the decorative element in a rotational motion about its own arbor 16.

When first wheel 26*b* of the gear train mounted or embarked on drive element 3 passes before one of inner racks 44, first wheel 26*b* rotates in one direction, causing rotation of first pinion 26*a* and then of wheel sets 28 and 30. Rotation of last wheel 30*b* causes translational motion of arbor 16 in one direction and thus translational motion of decorative element 2 in the same direction, owing to the screw/nut system and the square. At the same time, the rolling or friction sensing action of feeler element 34*b* on the profile of cam 36 causes oscillating rotation of decorative element 2 about its arbor 16, such that decorative element 2 is moved in a complex combined movement including a translational motion in one direction along its own arbor 16 and an oscillating rotational motion along its own arbor 16, while rotating about the central axis.

When first wheel 26*b* of the gear train mounted or embarked on drive element 3 passes before one of outer racks 45, first wheel 26*b* rotates in the other direction, causing rotation of first pinion 26*a* and then of wheel sets 28 and 30. Rotation of last wheel 30*b* causes translational motion of arbor 16 in the other direction and thus translational motion of decorative element 2 in this other direction, owing to the screw/nut system and square. Again, at the same time, the rolling or friction sensing action of feeler element 34*b* on the profile of cam 36 causes oscillating rotation of decorative element 2 about its arbor 16, such that decorative element 2 is moved in a complex combined motion including a translational motion in the other direction along its own arbor 16 and an oscillating rotational motion along its own arbor 16, while rotating about the central axis.

When first wheel 26*b* of the gear train mounted on drive element 3 does not encounter racks 44, 45, arbor 16 is no longer driven in translation, and decorative element 2 is moved in a combined movement including an oscillating rotational motion along its own arbor 16, while rotating about the central axis.

Thus, for one rotation about the central axis of drive element 3, decorative element 2 is moved in a complex combined movement comprising several up and down motions along its own arbor 16 and an oscillating rotational motion along its own arbor 16.

The invention is not limited to the example described. In particular, it is possible to implement only one of the motions of the decorative element in rotation about the arbor or in translation along the decorative element.

The invention claimed is:

1. A moving mechanism for a decorative element of a timepiece, the moving mechanism comprising:

a circular drive element arranged to be rotatable about a central axis, said decorative element being mounted on the circular drive element with an arbor integral with said decorative element and parallel to the central axis;

first means for driving said decorative element n a rotational motion about the arbor and/or in a translational motion along the arbor; and fixed actuation means arranged in a periphery of the circular drive element, wherein said first drive means for the decorative element is mounted on the circular drive element and arranged to cooperate with the fixed actuation means such that said decorative element rotates about the arbor and/or moves along the arbor while rotating about the central axis.

2. The moving mechanism according to claim 1, wherein the first means for driving the decorative element in a translational motion along the arbor include a gear train comprising at least a first wheel set arranged to cooperate with first fixed actuation means arranged in the periphery of the drive element, and a last wheel set, said last wheel set and the arbor of the decorative element being arranged to form a screw/nut system, the arbor of the decorative element being further arranged to have limited rotation at least when the first wheel set cooperates with the first fixed actuation means, such that rotation of the gear train causes translation of the arbor of the decorative element.

3. The moving mechanism according to claim 1, wherein the first means for driving decorative element in a rotational motion about the arbor include a radial feeler integral, at least in rotation, with the arbor of the decorative element, wherein the arbor of the decorative element and the radial feeler are mounted for free rotation on the drive element, and said radial feeler is arranged to cooperate with second fixed actuation means provided in the periphery of the drive element and arranged to modify the distance between said second fixed actuation means and the arbor of the decorative element.

4. The moving mechanism according to claim 2, wherein the arbor of the decorative element has an externally threaded area and the last wheel set has a corresponding internal thread and is mounted around said externally threaded area of the arbor of the decorative element.

5. The moving mechanism according to claim 2, wherein the first fixed actuation means are arranged to create an alternating translational motion.

6. The moving mechanism according to claim 5, wherein the first fixed actuation means include at least a first inner rack with external teeth and a second outer rack with internal teeth, said racks being concentric to the drive element and fixedly mounted on a frame in the periphery of the drive element on either side of the first wheel set, said first inner rack and second outer rack being distributed alternately in order for their respective toothings to cooperate alternately with the first wheel set, such that the decorative element moves along the arbor alternately moving closer to and away from the drive element.

7. The moving mechanism according to claim 3, wherein the mechanism includes the first means for driving the decorative element in a translational motion along the arbor and the first means for driving the decorative element in a rotational motion about the arbor, the radial feeler being disposed around the last wheel set and being integral in rotation with the arbor of the decorative element with a square to allow rotation of the decorative element about the arbor while allowing translation of said decorative element along the arbor, and the first and second fixed actuation means.

8. The moving mechanism according to claim 3, wherein the second fixed actuation means include a cam concentric to the drive element and fixedly mounted on a frame, said cam having a wavy profile arranged to cooperate with the radial feeler to create an oscillating rotational motion.

9. The moving mechanism according to claim 1, wherein the drive element is hollow at the centre thereof to be annular in shape and includes a drive crown.

10. The moving mechanism according to claim 9, wherein the mechanism includes second means for driving the circular drive element in rotation about the central axis arranged to cooperate with drive crown.

11. The moving mechanism according to claim 1, wherein the circular drive element is held radially on the frame by at least two runners mounted on a frame, one of the runners being fixed and the other runner being mobile.

12. A timepiece comprising:

a moving mechanism for a decorative element of a timepiece, wherein said moving mechanism includes a circular drive element arranged to be rotatable about a central axis, said decorative element being mounted on the circular drive element with an arbor integral with said decorative element and parallel to the central axis;

first drive means for driving said decorative element in a rotational motion about the arbor and/or in a translational motion along the arbor; and fixed actuation means arranged in a periphery of the circular drive element, wherein said first drive means for the decorative element is mounted on the circular drive element and arranged to cooperate with the fixed actuation means such that said decorative element rotates about the arbor and/or moves along its arbor while rotating about the central axis.

13. The timepiece according to claim 12, wherein the timepiece includes at least one energy accumulator for supplying the moving mechanism with energy, a governor for the moving mechanism, and a control mechanism for the moving mechanism, said control mechanism including first control means for starting and stopping the moving mechanism on demand by a user, and second control means arranged to stop the moving mechanism when the energy remaining in the energy accumulator reaches a determined energy threshold.

14. The timepiece according to claim 13, wherein the first control means of the control mechanism comprise a push button, a column wheel cooperating with said push button to move between a STOP position for stopping the moving mechanism and a GO position for starting the moving mechanism, and a first locking lever arranged to feel the STOP position and the GO position of the column wheel and to move between a governor locking position when the STOP position of the column wheel is detected, and an operating position wherein said governor is free when the GO position of the column wheel is detected.

15. The timepiece according to claim 13, wherein the second control means of the control mechanism include a second locking lever arranged to move between an operating position wherein governor is free, when the energy in the accumulator is higher than a determined threshold, and a governor locking position when the energy in the accumulator reaches said determined threshold.

16. The timepiece according to claim 15, wherein the timepiece includes a power reserve finger integrally mounted on a power reserve display wheel set kinematically connected to the energy accumulator, said power reserve finger being arranged to press on the second locking lever when the determined energy threshold is reached and to move said locking lever into its governor locking position.

* * * * *